US007267336B2

(12) United States Patent
Kojima

(10) Patent No.: US 7,267,336 B2
(45) Date of Patent: Sep. 11, 2007

(54) PAPER FEED TRAY AND PRINTER FURNISHED WITH THE TRAY

(75) Inventor: Yasushi Kojima, Nishinomiya (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 442 days.

(21) Appl. No.: 10/863,749

(22) Filed: Jun. 9, 2004

(65) Prior Publication Data

US 2004/0253032 A1 Dec. 16, 2004

(30) Foreign Application Priority Data

Jun. 10, 2003 (JP) ..... 2003-164526

(51) Int. Cl.
*B65H 1/00* (2006.01)

(52) U.S. Cl. ..... 271/145; 271/171; 271/157

(58) Field of Classification Search ..... 271/145, 271/157, 9.01, 9.06, 9.11, 9.22, 171; 399/377, 399/393; 379/441, 446, 447, 449, 450, 454, 379/455

See application file for complete search history.

(56) References Cited

U.S. PATENT DOCUMENTS 4,828,245 A * 5/1989 Shimogawara ..... 271/171
5,053,814 A * 10/1991 Takano et al. ..... 399/23
5,775,687 A * 7/1998 Nakatani et al. ..... 271/145
5,815,787 A * 9/1998 Crayton et al. ..... 399/393
6,412,772 B1 * 7/2002 Itoh et al. ..... 271/145
6,612,564 B1 * 9/2003 Todd ..... 271/145
6,827,414 B2 * 12/2004 Iwatsuki et al. ..... 347/14

FOREIGN PATENT DOCUMENTS

JP 55079434 A * 6/1980
JP 8-244995 9/1996
JP 2002-19975 1/2002

* cited by examiner

*Primary Examiner*—Patrick Mackey
*Assistant Examiner*—Gerald W McClain
(74) *Attorney, Agent, or Firm*—Kratz, Quintos & Hanson, LLP

(57) ABSTRACT

An auxiliary tray frame is attached attachably/reattachably to a tray unit. The auxiliary tray frame is a rectangular frame including a front frame portion, a rear frame portion, and both side frame portions. A fore-end of the auxiliary tray frame fits into a cut-out formed in a front wall of the tray unit, and a space surrounded by the front wall of the tray unit, and the auxiliary-tray rear frame portion and opposing side frame portions forms a small-sized paper sheet-accommodating space.

5 Claims, 8 Drawing Sheets

FIG. 11PRIOR ART
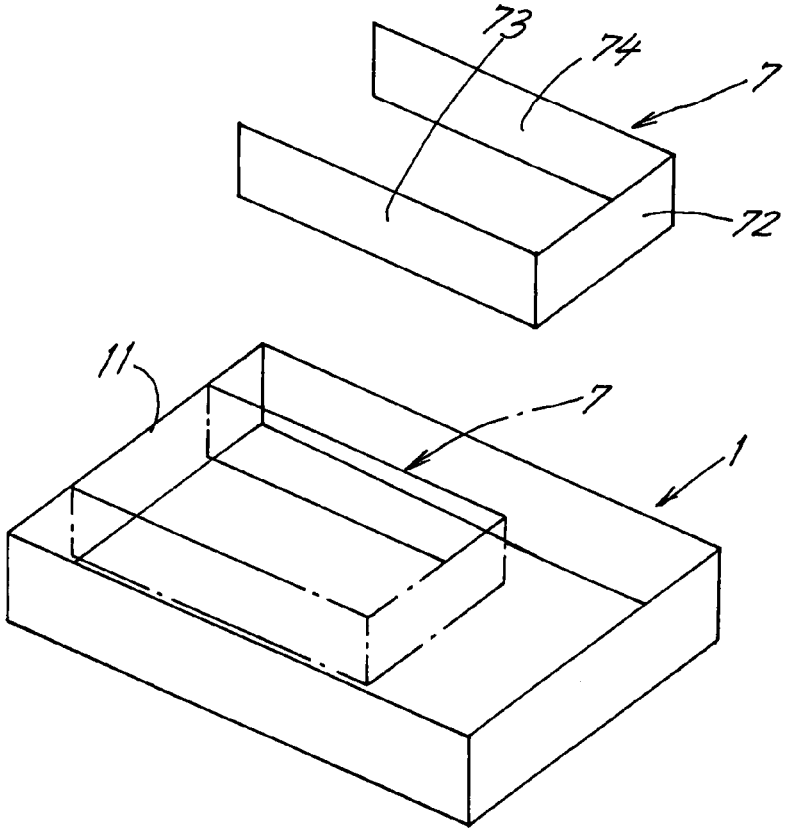

PAPER FEED TRAY AND PRINTER FURNISHED WITH THE TRAY

BACKGROUND OF THE INVENTION

1. Field of the Invention

The present invention relates to paper feed trays furnished inside with a mechanism for lifting a paper stack, and to printers furnished with the tray.

2. Description of Related Art

Paper feed trays are installed in a printer for printing images or the like and feed paper sheets to the printer. There is a type of paper feed tray in which an auxiliary tray frame adapted for smaller-sized paper sheets is attachable to a tray unit adapted for larger-sized paper sheets.

An example of a conventional auxiliary tray frame 7 is shown in FIG. 11. In FIG. 11, the left side of the figure is the front. In this configuration, the rear ends of opposing side frame portions 73 and 74 are connected by a rear frame portion 72, and the fore-ends of the side frame portions 73 and 74 are free ends. The auxiliary tray frame 7 is mounted in a tray unit 1 so that the fore-ends of both side frame portion 73 and 74 face a front wall 11 of the tray unit 1. The front wall 11 of the tray unit 1 also serves as the front wall of the smaller-sized paper sheet tray.

In both cases of large-sized paper sheets and small-sized paper sheets, paper sheets are drawn out from the upper end of the front wall 11 of the tray unit 1 by a paper-feeding roller of the printer (not shown).

The above-noted paper feed tray has the following problem. The just-noted auxiliary tray frame 7 lacks one of the four sides that make up the frame. For this reason, the strength is small against an external force that acts on the side frame portions 73 and 74. In many cases the auxiliary tray frame 7 is formed of a synthetic resin and is apt to break when the external force acts thereon.

The present invention is to disclose a paper feed tray that can solve the foregoing problem.

BRIEF SUMMARY OF THE INVENTION

In a paper feed tray in accordance with the present invention, an auxiliary tray frame 7 is a rectangular frame including a front frame portion 71, a rear frame portion 72, and opposing side frame portions 73 and 74. A fore-end of the auxiliary tray frame 7 fits into a cut-out 18 formed in a front wall 11 of a tray unit 1, and a space surrounded by the front wall 11 of the tray unit 1, and the rear frame portion 12 and opposing side frame portions 73 and 74 of the auxiliary tray frame 7 forms a smaller-sized paper sheet-accommodating space.

The auxiliary tray frame 7 includes four sides, namely, the front frame portion 71, the rear frame portion 72, and the opposing side frame portions 73 and 74, and therefore, the strength can be kept high against external force acting on the side frame portions 73 and 74.

In a state in which larger-sized paper sheets are accommodated in the tray unit 1, the position of the front end of the paper sheets is restricted by the front wall 11 of the tray unit 1.

When the auxiliary tray frame 7 is mounted in the tray unit 1 and smaller-sized paper sheets are accommodated in the auxiliary tray frame 7, the front end position of the paper sheets is also restricted by the front wall 11 of the tray unit 1. Thus, the front end position of the paper sheets is restricted by the front wall 11 of the tray unit 1 in both cases of larger-sized paper sheets and smaller-sized paper sheets.

Therefore, paper sheets can be set properly at a position to be drawn out by a paper-feeding roller regardless of paper size, and no problem arises in paper feeding.

BRIEF DESCRIPTION OF THE DRAWINGS

FIG. 11 is a perspective view illustrating a conventional auxiliary tray frame.

DETAILED DESCRIPTION OF THE PREFERRED EMBODIMENTS

First Embodiment

Outline of the Printer

Figure 1:
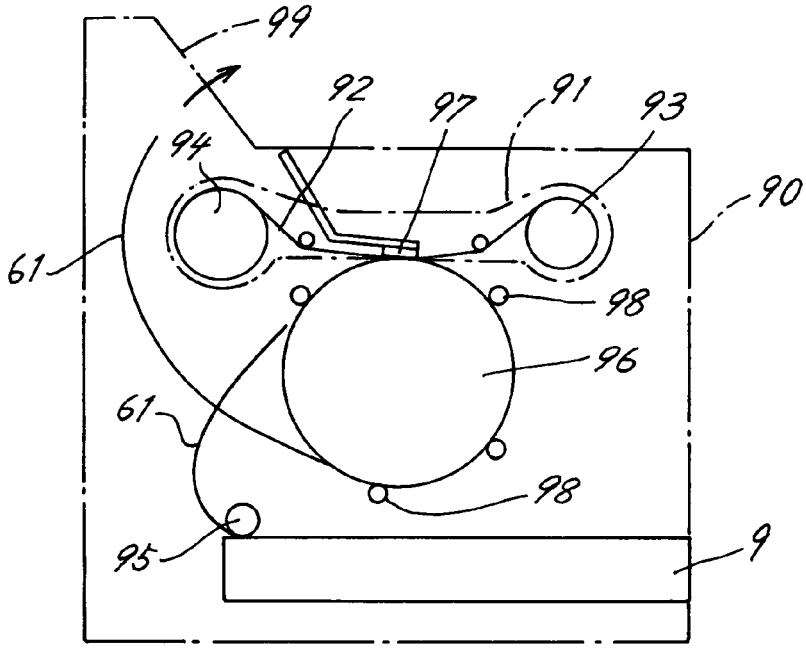
FIG. 1 is a schematic view of a printer to which a paper feed tray is mounted.

FIG. 1 is a schematic view showing a printer 90 to which a paper feed tray 9 according to the present invention is mounted. In the printer 90, the paper feed tray 9 and a cartridge 91 are mounted detachably/reattachably. The cartridge 91 is furnished inside with a supply roller 93 around which an ink sheet 92 is wound, and a take-up roller 94 that winds up the ink sheet 92.

When printing, an uppermost paper sheet 61 in the paper feed tray 9 is drawn out by a roller 95 one by one and wound around a platen roller 96. With the platen roller 96 being rotated, the ink sheet 92 is transferred by the take-up roller 94 while being heated with a thermal head 97, so that image data of yellow, magenta, and cyan are successively printed on the paper sheet 61. Upon completing the printing, the paper sheet 61 is ejected by a transfer roller 98 from an ejection part 99 formed on the upper end of the printer 90.

Paper Feed Tray

Figure 2:
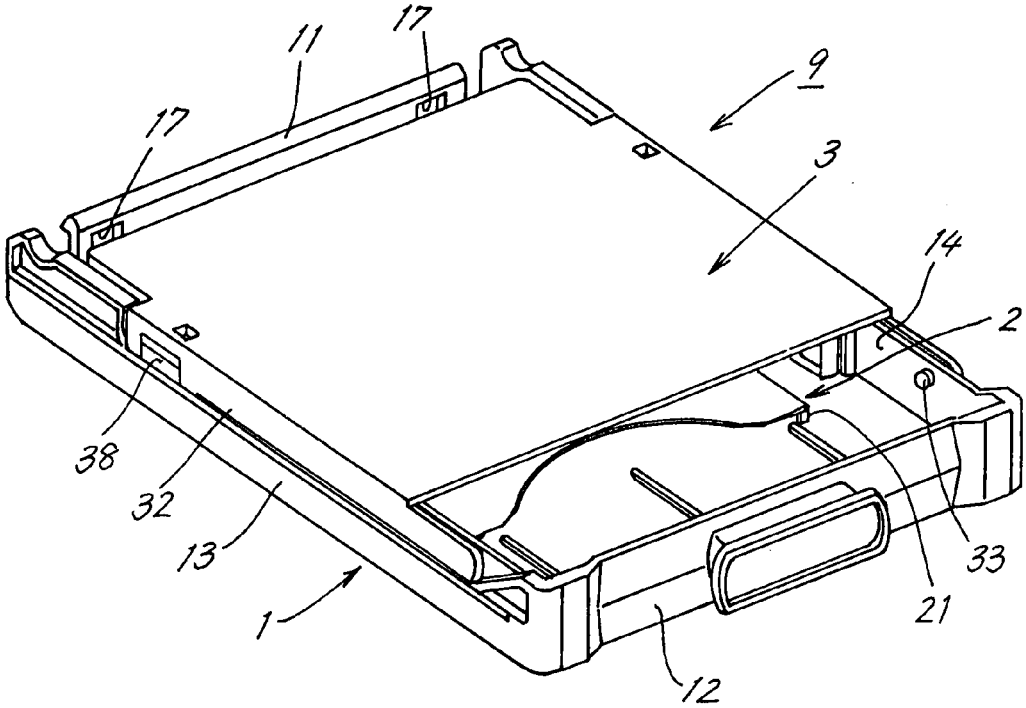
FIG. 2 is a perspective view of the paper feed tray.
Figure 3:
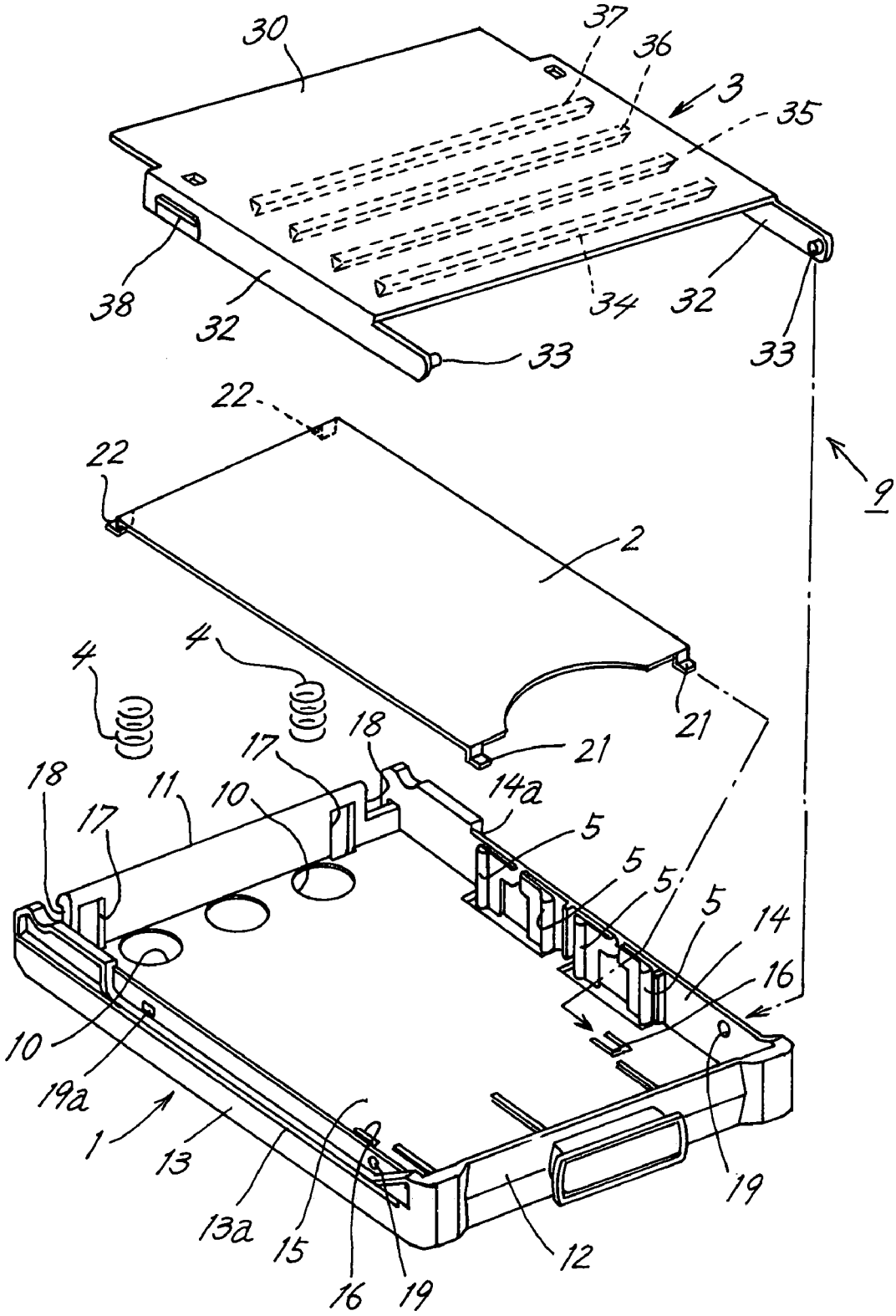
FIG. 3 is an exploded perspective view of the paper feed tray.

FIG. 2 is a perspective view of the paper feed tray 9, and FIG. 3 is an exploded perspective view thereof. The feature of this embodiment is that an auxiliary tray frame 7 is mounted detachably/reattachably in the tray unit 1. First of all, an outline of the paper feed tray 9 is described.

The paper feed tray 9 comprises a tray unit 1, a lifting member 2, springs 4, and a lid 3. The lifting member 2 is furnished on a floor part of the tray unit 1 and accommodated in the tray unit 1, and is for lifting the drawing side end of the paper stack 6. The springs 4 are for urging the front end of the lifting member 2 upward. The lid 3 has one end that is pivotably supported on a rear end of the tray unit 1, whereas the paper drawn end thereof is a free end. The lid 3 is formed by bending a metal plate so that a lid plate 30 and side pieces 32, 32, positioned on both right and left sides of the lid plate 30, are furnished integrally; and a round shaft 33, which serves as a pivot, protrudes from the inner side of the rear end of each side piece 32. In the present example, the reverse side of the lid plate 30 has a characteristic feature, as will be described later.

The lifting member 2 is a substantially rectangular-shaped plate extending along the front to back axis, and both rear side ends and both front side ends thereof are finished with claw pieces 21, 21 and 22, 22 protruding therefrom. Each claw piece 21 on the rear ends hangs on the lower face of the tray unit 1.

The tray unit 1 comprises a front wall 11, a rear wall 12, right and left side walls 13 and 14, and a floor plate 15, all of which are integrally formed of a resin. The roller 95 is arranged above the front wall 11.

The tray unit 1 has a size such that it can accommodate paper sheets having a size of 180 mm in length and 123 mm in width (Japanese postcard size), and extends along the front-to-back axis. The paper sheets have about the thickness of postcard.

One side wall 14 is furnished with a plurality of flat spring-like urging members 5 for pushing the paper stack 6 toward the other side wall 13.

Indented steps 13*a* and 14*a* to which the side pieces 32, 32 of the lid 3 are fitted are formed on both outer sides of the side walls 13 and 14. Shaft holes 19, 19, to which the round shafts 33, 33 of the lid 3 fit in from the outside, are formed through the inner sides of the indented steps 13*a* and 14*a* near the rear end, and a recess 19*a* for locking the lid 3 is formed on the inner sides of the steps 13*a* and 14*a* near the front end. Vertical grooves 17, 17, the upper ends of which are closed, are formed in two places on the inner face of the front wall 11, and the claw pieces 22, 22 of the lifting member 2 fit into the vertical grooves 17, 17. The claw piece 22 hits the upper edge of the vertical groove 17, thereby restricting the lifting height of the lifting member 2.

Two incisions 16, 16, into which the claw pieces 21, 21 of the lifting member 2 are fitted, are formed in the floor plate 15, and the lifting member 2 pivots around with the claw pieces 21, 21 being the center.

Two spring sheets 10, 10 are provided at two locations, on the right and the left in a front area of the floor plate 15, and the springs 4 fit into the spring sheets 10, 10.

Reverse Side of the Lid

Figure 4:
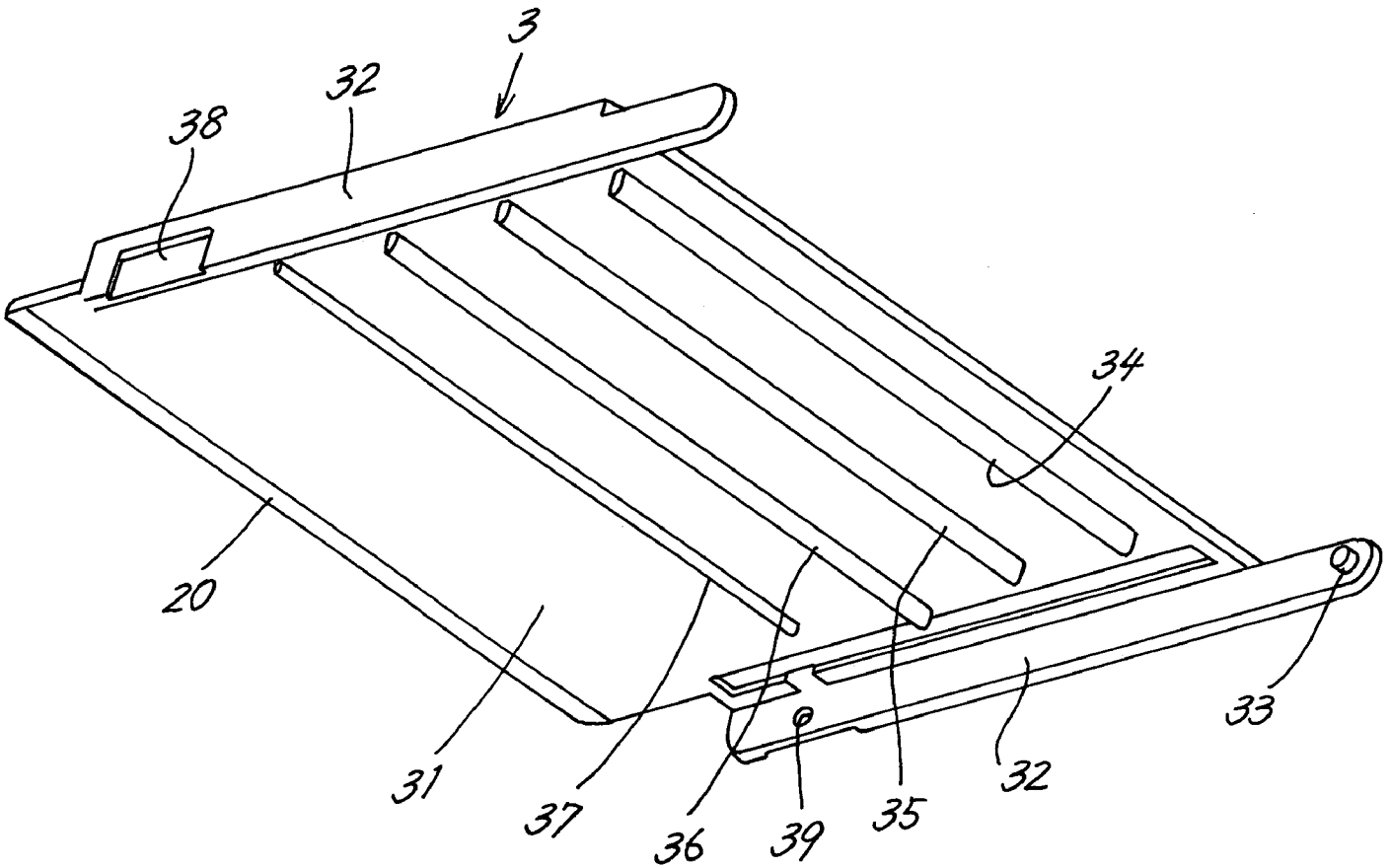
FIG. 4 is a perspective view of a lid, viewed from its reverse side.

FIG. 4 is a perspective view of the lid 3, viewed from its reverse side.

Four protruding parts 34, 35, 36, and 37 that are capable of pressing the paper stack 6 are provided on the lower face of the lid 3 from the pivotal center side to the free end side of the lid 3 at substantially equal intervals. Each of the protruding parts 34, 35, 36, and 37 is a straight-lined protruding part extending along a direction perpendicular to the direction in which paper sheets are drawn out (the direction along the pivotal axis of the lid 3). The fore-ends of the protruding parts 34, 35, 36, and 37 are rounded off in order to prevent them from scratching paper sheets.

The protruding heights of the protruding parts 34, 35, 36, and 37 increase in order of proximity to the pivotal axis of the lid 3. When closing the lid 3, they can push the paper sheets in order from the protruding part 34, which is closest to the pivotal axis of the lid 3.

Immediately before completing the closing of the lid 3, the free end of the lid 3 presses the front end of the paper stack 6 downward against the springs 4. When the lid 3 is closed, the paper stack 6 can be accommodated in the tray unit completely.

In the embodiment, each of the protruding parts 34, 35, 36, and 37 is not in contact with the paper stack 6 in the state in which the paper stack 6 is accommodated completely in the tray unit 1. Specifically, the heights of the protruding parts 34, 35, 36, and 37 are 4 mm, 2.5 mm, 2 mm, and 1 mm, respectively; the interval between the protruding parts is about 20 mm; and the distance between the rearmost protruding part 34, which has the largest protruding height, and the inner face of the tray-unit rear wall 12 is about 42 mm.

Finger-hold recesses 38 are formed on the side pieces 32, 32 near the front, and protuberances 39 are formed protruding from the back of the recesses 38. When closing the lid 3, the protuberances 39 hit the side walls 13 and 14 of the tray unit 1 and thereafter fit into the recesses 19*a* in the side walls 13 and 14 due to the elastic deformation of the resin, causing the lid 3 to be latched softly in a closed state.

When locking the lid 3, the lid plate 30 becomes parallel to the tray unit floor plate 15 and the height of the lid plate 30 is level with the height of the circumferential walls of the tray unit 1.

In addition, the free end of the lid plate 31 is positioned about 8 mm rearward of the front face of the tray-unit front wall 11.

Lid Closing Operation

Figure 5:
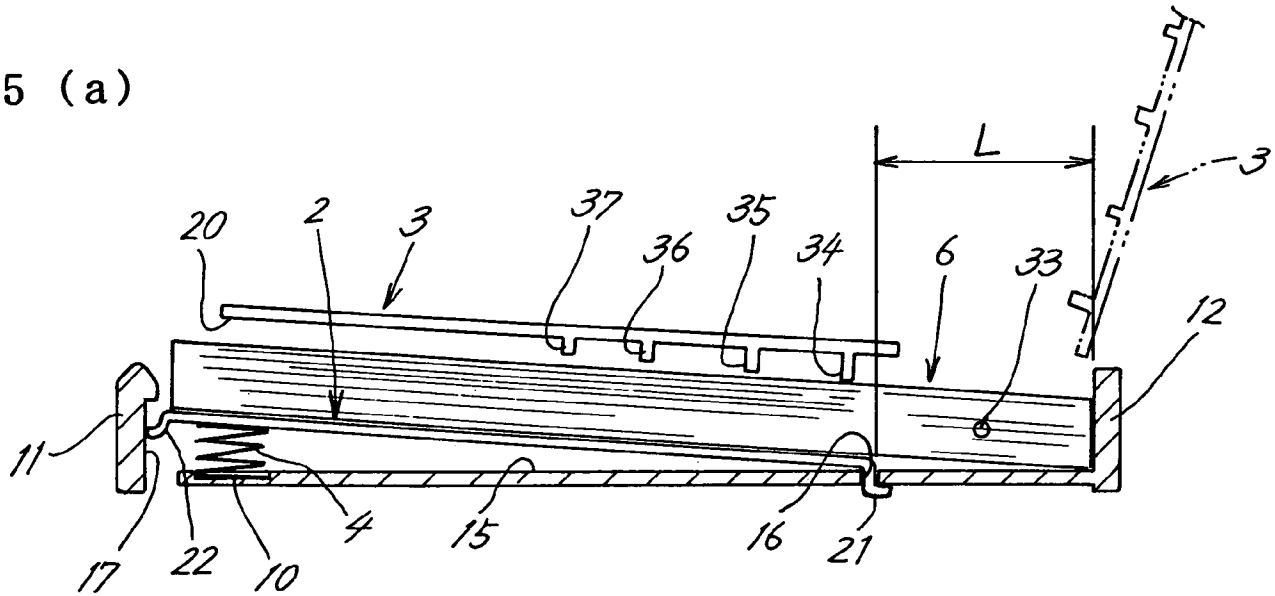
FIGS. 5(*a*) and 5(*b*) are side cross-sectional views illustrating a tray unit, in which a paper stack is accommodated.
Figure 5:
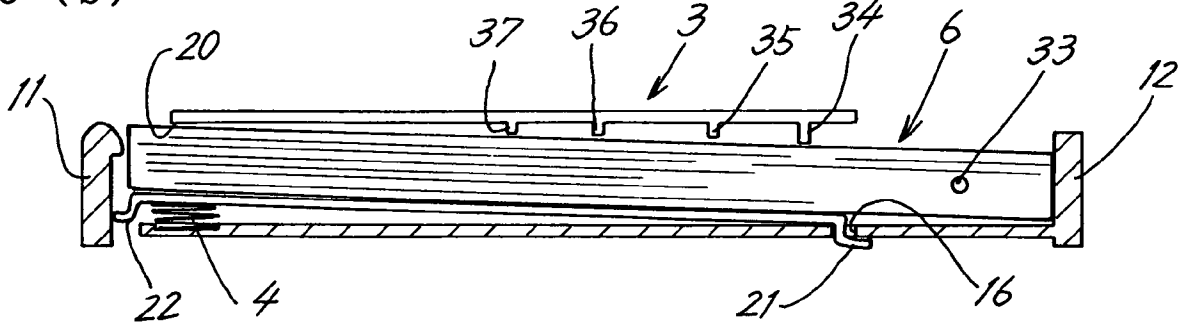

FIGS. 5(*a*) and 5(*b*) are side cross-sectional views illustrating the tray unit 1 in which the paper stack 6 is accommodated. For convenience in illustration, the side pieces 32, 32 of the lid 3 are not shown. Distance L from the inner face of the rear wall 12 to the rear end of the incision 16 is about 45 mm, which is about ¼ of the length of the paper sheets.

To accommodate the paper stack 6 in the tray unit 1, the lid 3 is opened as illustrated in FIG. 5(*a*). One end of the paper stack 6 along its longitudinal sides is put against the inner face of the rear wall 12 of the tray unit 1 to place the paper stack 6 on the lifting member 2.

The force of the springs 4 exceeds the weight of the paper stack 6, and the paper stack 6 tilts together with the lifting member 2. That is, the rear end of the paper stack 6 stays within the tray unit 1, but the front end juts out from the tray unit 1.

Under this condition, the lid 3 is closed as illustrated in FIG. 5(*b*) with the hand. Of the protruding parts 34, 35, 36, and 37 of the lid 3, the protruding part 34 that is closest to the pivotal axis of the lid 3 pushes the rear end of the paper stack 6 downward.

Since the rear end of the paper stack 6 is fitted in the tray unit 1 and the rear end of the paper stack 6 is pushed downward by the protruding part 34, the paper sheets are not misaligned even if an unexpected force is applied to the tray unit 1.

As the lid 3 pivots in the closing direction, the protruding parts 35, 36, and 37 push the paper stack 6 in order of proximity to the pivotal axis of the lid 3. The paper stack 6 gradually fits into the tray unit 1 from the rear-end side.

Just before the lid 3 is completely closed, the free end of the lid 3 holds the paper stack 6. The protruding parts 34, 35, 36, and 37 move away from the paper stack 6.

By locking the lid 3 in a closed condition, the free end of the lid 3 keeps pressing the paper stack 6. Since the protruding parts 34, 35, 36, and 37 are away from the paper stack 6, the drawing resistance is small when the uppermost paper sheet 61 is drawn out by a drawing roller.

The shape, size, arrangement, and number of the protruding parts 34, 35, 36, and 37 may be varied as appropriate according to size of the tray, types of paper sheets, or the like. What is important is that the protruding parts press the rear end of the paper stack 6, which is the rear end that fits into the tray unit 1, before the free end of the lid 3 pushes the paper stack 6.

Providing on the rear end of the lid 3 only one protruding part 34 that can push the paper stack 6 is effective to prevent misalignment of paper sheets.

Alternatively, the protruding part may be formed of such a straight-lined protruding part (not shown) extending along the front-to-rear orientation of the lid 3 that its height gradually decreases from the pivotal axis of the lid 3 toward the free end of the lid 3. If a plurality of such straight-lined protruding parts are provided on both right and left sides of the lid 3 to press both right and left side ends of the paper sheets, misalignment of paper sheets can be prevented more effectively.

Auxiliary Tray Frame

Figure 6:
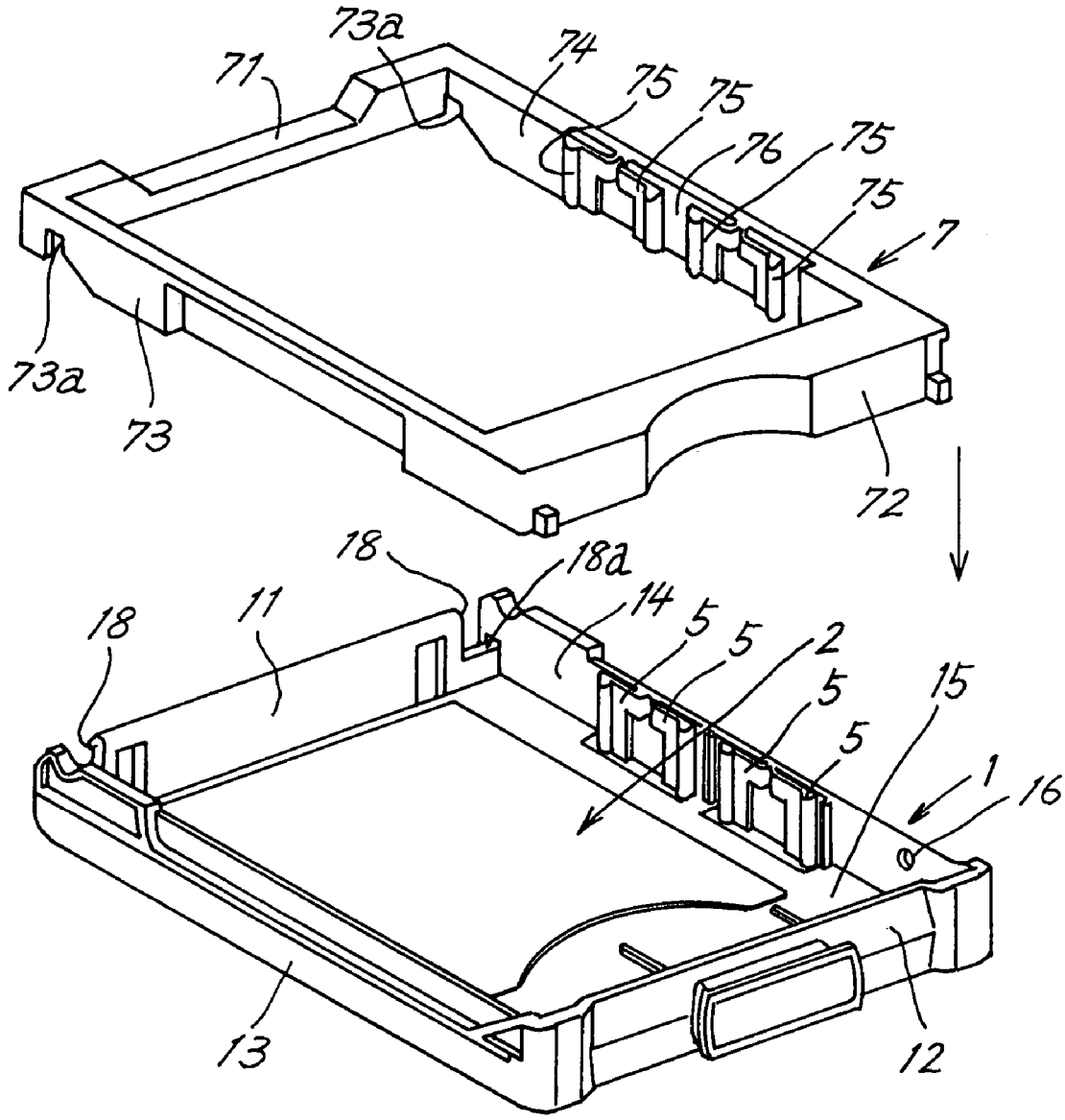
FIG. 6 is a perspective view of an auxiliary tray frame and a tray unit.
Figure 7:
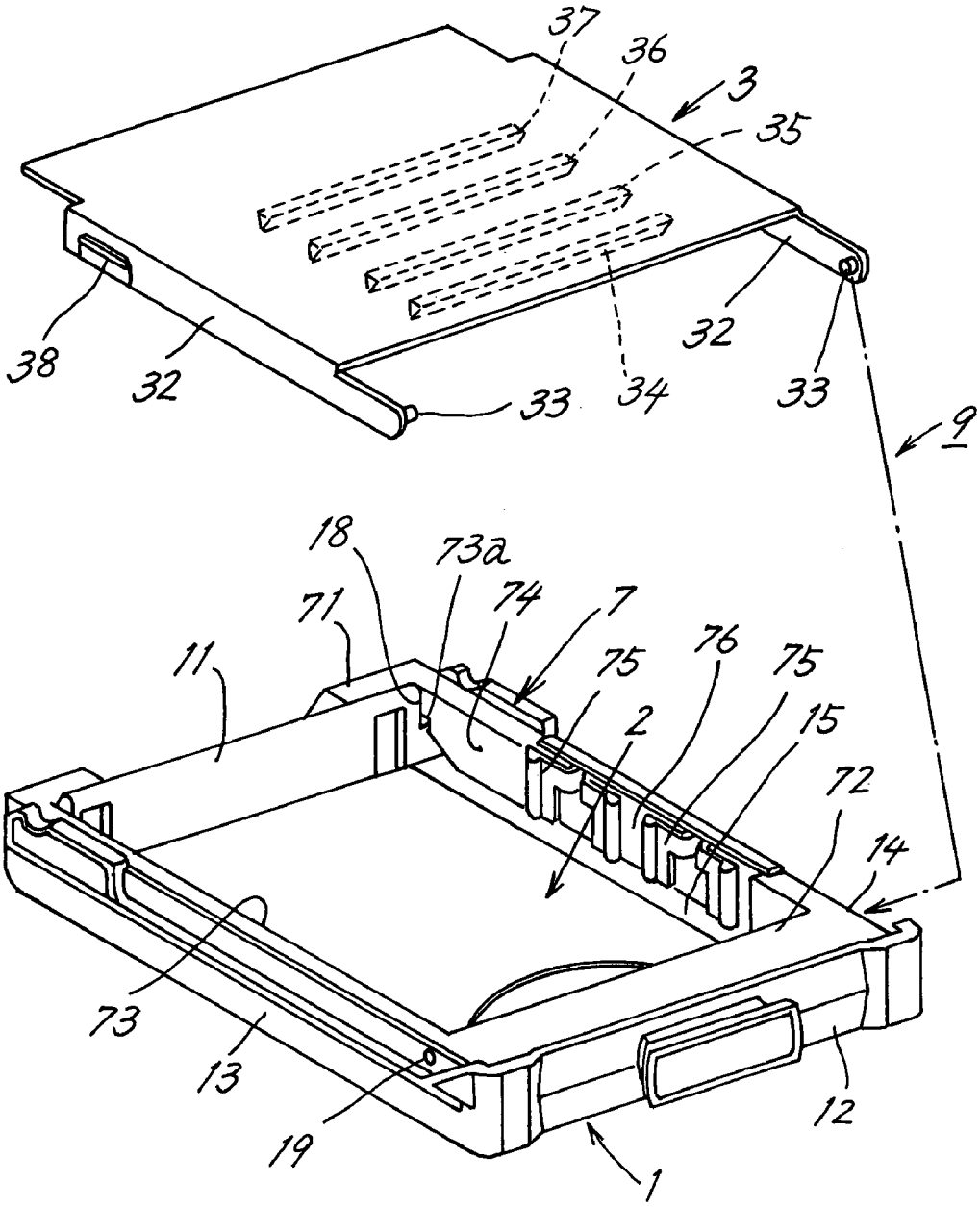
FIG. 7 is a perspective view illustrating a state in which the auxiliary tray frame is mounted in the tray unit.

In the foregoing embodiment, the size of paper sheets is a postcard size, but there are cases in which it is desired to use paper sheets with a size smaller than the postcard size, such as those with a photograph size, for printing. In light of this fact, according to the present embodiment, an auxiliary tray frame 7 adapted for photograph-sized paper sheets can be mounted on the lifting member 2 in a tray unit 1. FIG. 6 is a perspective view of the auxiliary tray frame 7 and the tray unit 1, and FIG. 7 is a perspective view illustrating a state in which the auxiliary tray frame is mounted in the tray unit. In FIGS. 6 and 7, springs 4 are omitted for convenience in illustration. A lid 3 is supported pivotably on the outside of the tray unit 1.

Cut-outs 18, 18 for fitting the auxiliary tray frame 7 are formed in both side ends of a front wall 11.

The auxiliary tray frame 7 is a rectangular frame comprising a front frame portion 71, a rear frame portion 72, and opposing side frame portions 73 and 74. The side frame portions 73 and 74 of the auxiliary tray frame 7 have notches 73*a* near the front end, into which the lower edges of the cut-outs 18 of the tray unit 1 fit. One side frame portion 74 is furnished with a plurality of flat spring-like urging members 75, 75 for pushing a side edge of small-sized paper stack toward the other side frame portion 73. The auxiliary tray frame 7 is pushed toward the side wall 13 by urging members 5 of the tray unit.

In order for the lifting member 2 to support the paper stack 6 stably, it is desirable that the width of the lifting member 2 be as wide as possible. In the embodiment, the lifting member 2 is formed to have a maximum width that does not interfere with the auxiliary tray frame.

As illustrated in FIG. 7, the rear frame portion 72 of the auxiliary tray frame 7 hits the inner face of the rear wall 12 of the tray unit 1 in a state in which the auxiliary tray frame 7 is fitted in the tray unit 1. The fore-ends of opposing side frame portions 73 and 74 fit into the cut-outs 18, 18 of the front wall 11, and the front frame portion 71 of the auxiliary tray frame 7 is located outside the front wall 11.

The space in the auxiliary tray frame 7 that is surrounded by the side frame portions 73 and 74, the rear frame portion 72 and the front wall 11 of the tray unit 1 is a small-sized paper-accommodating region.

Mounting Auxiliary Tray Frame

The procedure of mounting the auxiliary tray frame 7 to the tray unit 1 is explained. The lid 3 is opened and the rear frame portion 72 of the auxiliary tray frame 7 is put against the inside of the rear wall 12. The fore-ends of the side frame portions 73 and 74 are fitted into the cut-outs 18, 18 of the front wall 11. The lower edge 18*a* of each cut-out 18 fits into each notch 73*a* of the side frame portions 73 and 74, restricting frontward/rearward movements of the auxiliary tray frame 7.

Leftward/rightward movements of the auxiliary tray frame 7 are restricted by the urging members 5 pushing the auxiliary tray frame 7 toward the side wall 13 in the tray unit 1. As described above, the auxiliary tray frame 7 can be mounted in the tray unit 1 easily.

In a state in which the auxiliary tray frame 7 is mounted in the tray unit 1, the front frame portion 71 is positioned outward of the front wall 11 of the tray unit 1. Therefore, the frontward movements of the small sized paper sheets accommodated in the auxiliary tray frame 7 is restricted by the front wall 11. Paper size can be automatically detected if a detector, such as a switch, a sensor, or the like, for detecting the front frame portion 71 is furnished in the printer in which the tray unit 1 is to be mounted.

Second Embodiment

Figure 8:
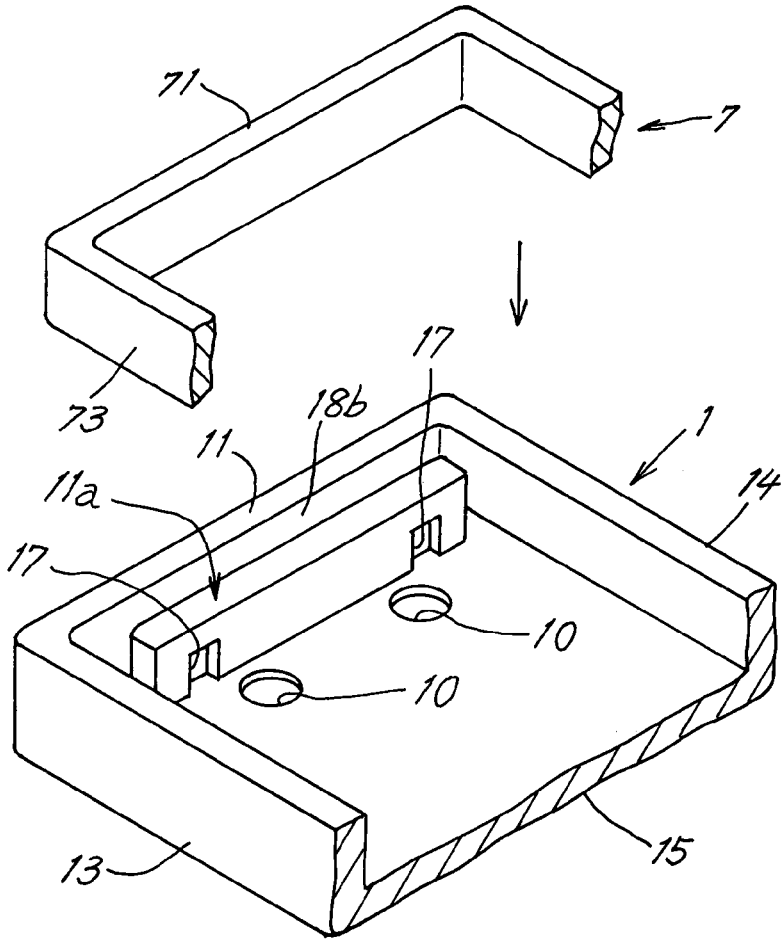
FIG. 8 is a perspective view illustrating a primary portion of the auxiliary tray frame and a tray unit according to another embodiment.
Figure 9:
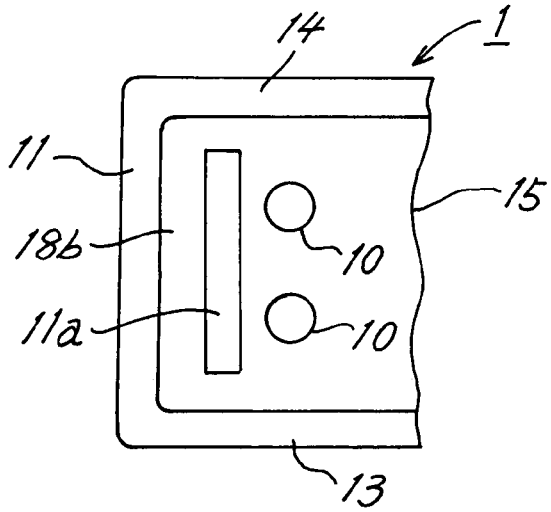
FIG. 9 is a plan view illustrating a primary portion of the tray unit of FIG. 8.
Figure 10:
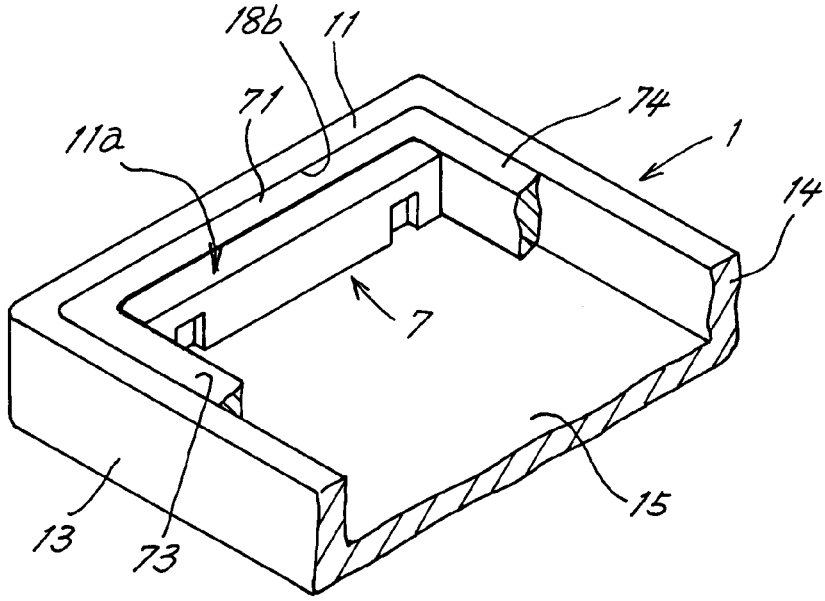
FIG. 10 is a perspective view illustrating a state in which an auxiliary tray frame is mounted in the tray unit of FIG. 8.

FIG. 8 is a perspective view illustrating a primary portion of an auxiliary tray frame 7 and a tray unit 1 according to another embodiment, and FIG. 9 is a plan view illustrating a primary portion of the tray unit 1. A sub-wall 11*a* having a smaller side-to-side width than that of the front wall 11 is furnished on the floor plate 15 of the tray unit 1 at the rear of the front wall 11, to provide an accommodating groove 18*b* between the front wall 11 and the sub-wall 11*a*, into which the front frame portion 71 is inserted. As shown in FIG. 10, the front frame portion 71 is inserted into the accommodating groove 18*b* to attach the auxiliary tray frame 7 in the tray unit 1. The inner face of the sub-wall 11*a* restricts frontward shifting of smaller-sized paper sheets in the auxiliary tray frame 7.

In the present embodiment, the protruding parts 34, 35, 36, and 37 of the lid 3 are designed to have such lengths that they do not interfere with the auxiliary tray frame 7, in order for the auxiliary tray frame 7 to be attachable to the tray unit 1. However, if the auxiliary tray frame 7 is provided with grooves or recesses for letting the protruding parts 34, 35, 36, and 37 escape, the protruding parts 34, 35, 36, and 37 may be extended approaching near the side walls 13 and 14 of the tray unit.

In the embodiment, the protruding part 35, one of the protruding parts, is formed to have such a length that an end thereof enters an escape gap 76 between the urging members 75, 75 of the auxiliary tray frame 7.

When the auxiliary tray frame 7 is mounted in the tray unit 1 to feed small-sized paper sheets as well, misalignment of paper sheets is effectively prevented as with the foregoing.

In the foregoing embodiments the tray unit 1 is furnished with the springs 4 for lifting the lifting member 2. However, there is a type of paper feed tray in which the lifting member 2 is lifted by a lifting member-elevating mechanism (not shown) provided in the printer according to consumption of paper sheets. The present invention can also be applied to this type of paper feed tray. Furthermore, the paper feed tray of the present invention can be applied not only to those for printers but also to paper feed trays for photocopiers. A resilient member such as sponge can be used instead of the springs 4.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

What is claimed is:

1. A paper feed tray comprising:

a tray unit for accommodating large-sized paper sheets, the tray unit having a rear wall, opposing sidewalls and a front wall in which a cut-out is formed and sheets are drawn out in a direction to pass over the front wall of the tray unit;

an auxiliary tray frame adapted for paper sheets smaller-sized than the sheets the tray unit accommodates, the auxiliary tray frame mounted detachably/reattachably in the tray unit and being a rectangular frame including a front frame portion, a rear frame portion, and opposing side frame portions; wherein a fore-end of the auxiliary tray frame fits into the cut-out in the front wall of the tray unit and forming a smaller-sized paper sheet-accommodating space bounded by the tray unit front wall, and the auxiliary tray rear frame portion and the auxiliary tray opposing side frame portions.

2. The paper feed tray according to claim 1, wherein:

the tray unit has cut-outs formed at both end portions of the front wall and opening on the front wall upper face; and fore-ends of the opposing side frame portions of the auxiliary tray frame fit into the cut-outs, with the front frame portion of the auxiliary tray frame being located outside of the front wall of the tray unit.

3. The paper feed tray according to claim 1, wherein the tray unit has an accommodating groove formed on an inner surface of the front wall, and the fore-end of the auxiliary tray frame fits into the accommodating groove.

4. The paper feed tray according to claim 1, wherein:

the tray unit is furnished with a lid and a spring-urged lifting member for lifting paper sheets accommodated in the tray unit at their drawn-out end; and the lid is attached pivotably to the tray unit and has a free end near where paper sheets are drawn out and a protruding part capable of pressing downward on the paper sheets at the end opposite to where they are lifted.

5. A printer comprising a paper feed tray according to claim 1 and a roller for drawing out paper sheets from the paper feed tray.

* * * * *